United States Patent [19]

Pate et al.

[11] 3,946,571

[45] Mar. 30, 1976

[54] SERVICE MODULE FOR HOSTILE ENVIRONMENT

[75] Inventors: Oscar Glenn Pate; Angus Loughlin Lyons, Jr., both of Houston, Tex.

[73] Assignee: Dresser Industries, Inc., Dallas, Tex.

[22] Filed: Feb. 6, 1975

[21] Appl. No.: 547,850

[52] U.S. Cl. ..... 61/69 R; 61/46; 175/219

[51] Int. Cl.[2] ..... B63C 11/44

[58] Field of Search ..... 61/69, 63, 46, 1; 175/219; 52/27

[56] References Cited

UNITED STATES PATENTS

| | | | |
|---|---|---|---|
| 3,030,122 | 4/1962 | Madera | 61/1 |
| 3,323,312 | 6/1967 | Banjavich | 61/69 |
| 3,477,234 | 11/1969 | Aquino | 61/69 |
| 3,626,836 | 12/1971 | Schneidler | 175/219 X |

*Primary Examiner*—Jacob Shapiro
*Attorney, Agent, or Firm*—Michael J. Caddell

[57] ABSTRACT

A service module adapted for service work while protecting workers in hostile environments utilizes an insulated capsule to be lowered over the service area, which capsule contains a work area inside for workmen to perform the required service operations. Power and materials are supplied to the inside of the capsule by an umbilical connected to external sources and the capsule has an entranceway connectable to external transportation means to fully protect the workers when transferring into and out of the capsule.

13 Claims, 7 Drawing Figures

SERVICE MODULE FOR HOSTILE ENVIRONMENT

BACKGROUND OF THE INVENTION

When working under less than ideal conditions in hostile environments such as in Alaska and the North slope, even the simplest tasks which must be performed outdoors during the winter months often involve insurmountable difficulties. For instance, with the recent burgeoning of oil exploration and production efforts in these cold environments, during such simple tasks as wellbore cementing and well servicing, where workmen must move outside sheltered areas to work with cumbersome machinery around a well site in an unsheltered area, temperatures may range from 50° to 90° below zero, Farenheit.

This is particularly true in the construction of the proposed Alaskan pipeline across the southern portion of the state of Alaska. Due to the destructive effect heavy vehicles have on the unfrozen tundra, construction of the pipeline is limited to the time during the winter months when the tundra is frozen hard and less susceptible to damage from heavy vehicles. Unfortunately, the time period ecologically suitable for construction is the most undesirable with respect to safety and comfort of the workmen on the construction project.

For example, at 80° below zero, man's concepts of the environment which are normally valid in temperatures above zero, become almost useless as the extreme cold affects properties of men, machines and materials adversely. Metals which are tough and strong at normal temperatures become brittle and weak at 80° below zero. Motor oil turns into an almost solid mass. Elastomerics and plastics for the most part become brittle and weak. Exposure of a man's bare skin to a sharp wind at this extremely low temperature may cause frostbite in only seconds.

The proposed construction of the Alaskan pipeline involves the boring of holes at periodic intervals through the tundra and the grouting-in of long piles upon which elevated supports will be constructed to suspend the pipeline above ground surface. One particularly suitable method of grouting such piles is disclosed in U.S. Pat. No. 3,839,874 in which water and then sand are placed around the pile in the borehole and compacted by vibration. This method contemplates the location of pumping equipment, sand conveying equipment, and operating personnel around the borehole at ground surface. The extremely bitter cold at the surface makes working with such equipment hazardous and difficult for the workmen grouting the piles.

The present invention solves these problems by providing a sheltered working environment with protection against the cold for the workers and containing all the necessary apparatus for performing the required operations at the borehole location.

DESCRIPTION OF THE PREFERRED EMBODIMENTS

Figure 1:
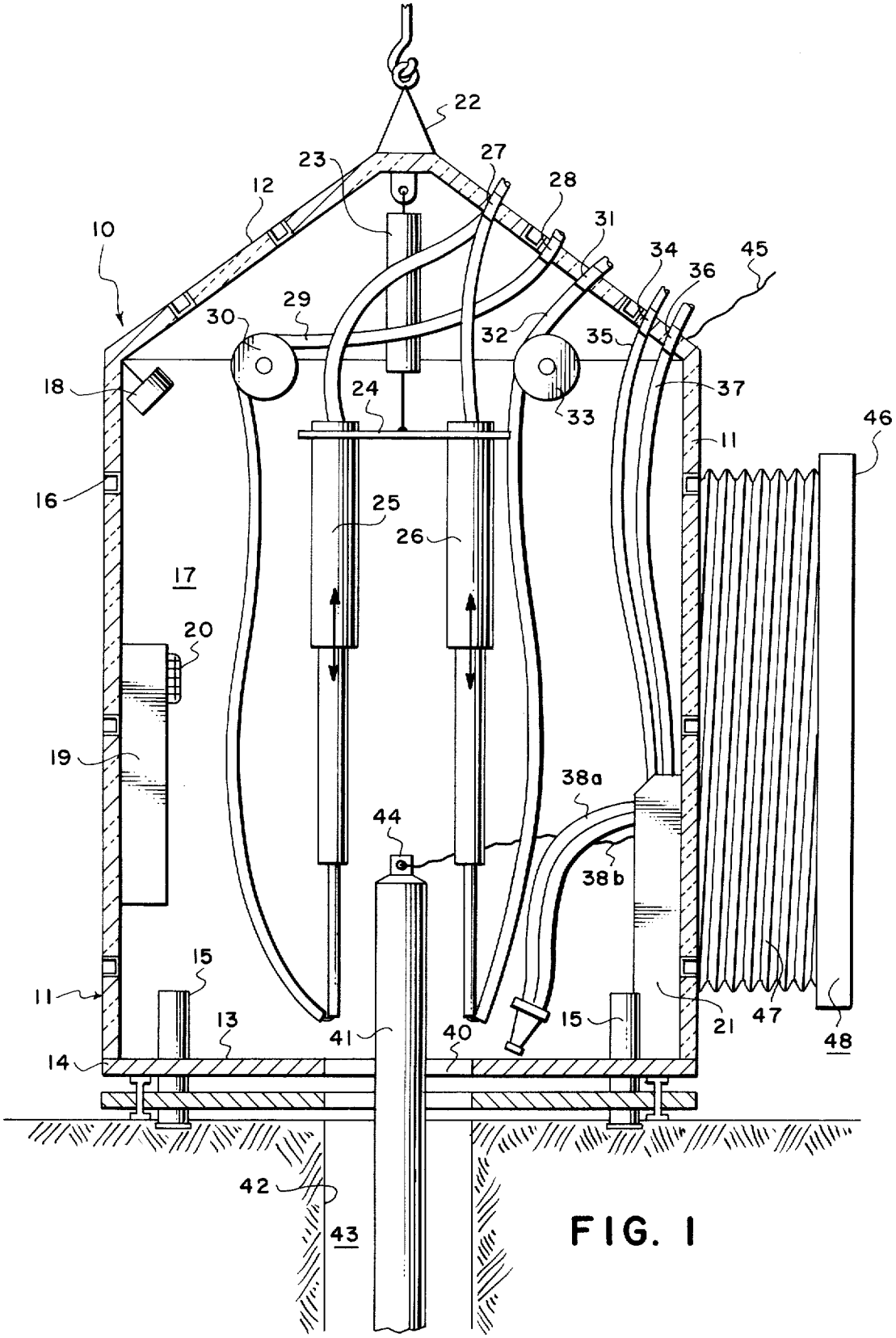
FIG. 1 illustrates a cutaway view of the slurry capsule of this invention.

FIG. 1 illustrates one embodiment of the invention in which is disclosed a rectangular slurry module 10 having four vertical side walls 11, an angular roof 12, and a compound floor 13. Each of the members 11 through 13 comprises a double wall structure having insulation 14 therein. A plurality of jackup systems 15 extend through floor 13 to provide adjustable support for the capsule on the surface on which it is located.

Lateral structural support beams 16 may be located in the walls, ceiling, and roof to provide structural integrity for the unit. The slurry capsule 10 encloses a work area 17 sufficiently large to allow one or more workmen to move about therein. The inner walls of the capsule 10 preferably have mounted thereon various devices to aid the workmen in performing the necessary services at the borehole. For instance, lights and/or heaters 18 may be mounted near the upper edge of the walls or in the roof member 12. Also storage cabinets 19 having intercom speakers 20 may be supported on the inner walls.

A control panel 21 is located along the inner wall of storage cabinet 19. Additional heating units may be located along the floor below cabinet 19 around the inner walls as required. At the top center of the roof section 12 is attached a hook 22 to which may be attached a crane line for lifting and lowering the service module onto the borehole site. On the inside of the module near the center of the roof is attached an hydraulic cylinder 23 from which is suspended the frame system 24 which holds one or more telescopic grouting tube assemblies 25 and 26. The grouting tube assemblies are designed to extend to a position near the floor of the service module.

Through a wall or through a roof member, or both, pass a plurality of flow tubes 27 adapted to carry materials and power supply into the interior of the service module. For example, sand lines pass through tube 27 and are connected to telescopic tubings 25 and 26 for the introduction of grouting sand into the borehole during the grouting process. Tube 28 may provide access for water line 29 which may be suspended from a pulley 30 and attached to the lower end of grouting tube 25 to provide grouting fluid with the sand.

Likewise, tube 31 allows access to the service module for a second water line 32 suspended from pulley 33 and attached to the lower end of grouting tube 26 for supplying grouting fluid to the opposite side of the borehole. Pulleys 30 and 33 alternately may be replaced by spring loaded hose reels to provide flexibility and adjustable length when using the water hoses and telescopic grouting tubes. Access tube 34, passing through the roof of the service module 10, provides passage of an air hose 35 which is connected into control panel 21. Access tube 36 provides access for a cement slurry hose 37 which is also connected into the control panel 21. Mixing valve apparatus and control panel 21 receives the water and cement supply and premixes it according to the operators desire, where-upon it is pumped from the panel through slurry supply hoses 38*a* and 38*b* into the pile or the borehole, whichever the case may be. It is contemplated that mixing apparatus and pumping means not shown are located within control panel 21 to provide mixing and displacement of the slurry mixture when desired. Various controls on the control panel 21 allow the operater to dial the desired mixture proportion and pumping rate during the operation.

A circular or other shaped opening 40 is formed in the bottom structure of the service module to allow the service module to be placed over the borehole site containing the upwardly extending pile 41. The borehole is designated as 42 and forms an open annular area 43 between the hole wall and the pile. According to one method of grouting piles in place, an electrical actuated vibrator 44 is placed atop pile member 41 to provide necessary compaction of the grouting slurry in the borehole.

An electrical power line 45 passes through the roof of the service module to control panel 21 where electrical power to the vibrator is controlled by operating personnel. During a typical grouting operation involving a borehole and pile, the borehole 42 will be bored through the frozen tundra by a special drilling rig and then a pile member 41 will be lowered into the hole until it abuts the bottom of the borehole leaving an extended portion remaining above the ground surface. Then the service module 10 will be lowered into place over the extended pile and borehole, with the lower center hole 40 passing downward over the pile.

The jacks 15 which may be hydraulic, pneumatic, or electrically actuated are activated to provide leveling and support for the service module. In one preferred embodiment, four such jacks were used, one near each corner of the rectangular service module. After the module has been leveled and the jacks placed into proper supporting position, the telescopic sand supply tubes 25 and 26 will be extended downward from frame 24 until they are in close proximity to the borehole annulus 43. At that time, water lines 29 and 32 will also be properly positioned due to their attachment to the lower ends of the grouting tubes 25 and 26. Then sand and water in proper sequences and proper ratio are applied to the borehole through tubes 25, 26 and hoses 29 and 32 until proper grouting of the pile has been performed. Should it become necessary to apply cement slurry into the pile for the upper part of the annulus after the sand and water grout has been performed, this can be accomplished through the use of control panel 21, hoses 38*a* and 38*b*, and the nozzles attached thereto.

Thus, it can be seen from the description above, that a self-contained working module is provided for working personnel, which module contains all of the necessary equipment and supply apparatus for providing the necessary grouting of the pile and the borehole. The personnel are allowed freedom to move about without bulky clothing but are protected from the bitter environment outside of the module. Due to the insulation in the walls and the airtight construction and due to the design of the module which opens only downward over the borehole, very little protective clothing is needed by the workmen. The module being heated also results in the various grouting equipment being at rather relatively warm temperatures thereby allowing the operators great freedom of use without requiring bulky insulated gloves.

It is contemplated that a bellows type entranceway 46 having an expandable, collapsible passage element 47 with a ridged doorway from 48 may be used to provide entrance and exit from the slurry capsule. After placement of the capsule over the borehole, a life support vehicle such as an insulated, heated van type vehicle may be backed up to the service module 10 until the door of the van mates with the expandable door structure 46 which may contain magnetic means to attach the door to the support van. Thus, once the exit door of the van comes into contact with the bellows 46 and the magnetic grip of the door 46 seals the door against the van wall, workmen may pass from the van through the bellows passage way 47 and into the service module thereby completely eliminating the need for the workmen to be exposed to the cold environment.

An inner sliding door or folding door may be provided in the wall of the surface module to allow the workmen to pass from bellows entranceway 47 into the inner work area 17 of the module. Once inside the module, the sliding doors can be closed again allowing the life support van to drive off from the service module and perform other duties. Preferably, heating elements in the module may be activated prior to entrance of the operating personnel so that the interior of the module will be prewarmed before the workmen begin their job.

Figure 2:
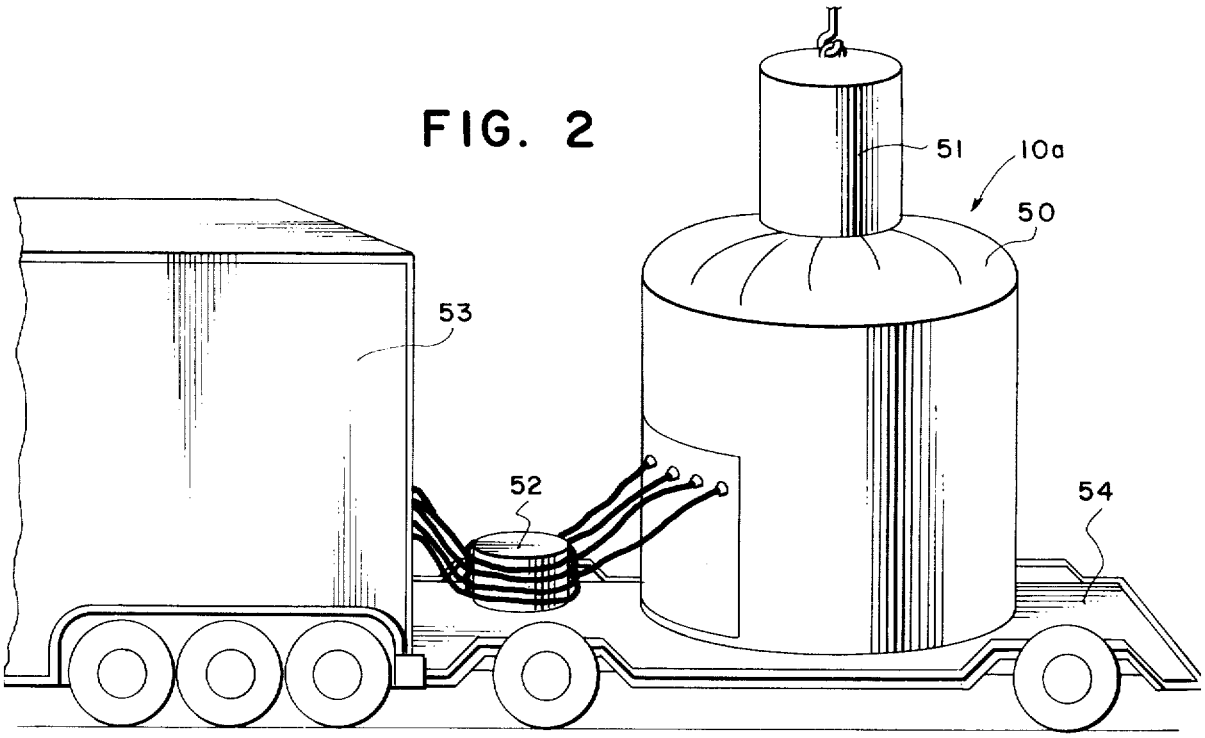
FIG. 2 is a pictorial view of a different embodiment of the capsule on a trailer carrier.

FIG. 2 illustrates another embodiment of the invention similar to the embodiment of FIG. 1 except that the service module 10*a* is cylindrical in nature, having a domed cap 50 and a smaller cylindrical upper extension 51 thereon. A support van 53 is attached by hitch means to a capsule support trailer 54 upon which the service module rests during transportation. Power supply cables and material hoses passing from support vehicle 53 into service module 10*a* may be coiled at 52 on trailer 54. Upon reaching the site a crane or hoist hooks into the service module 10*a* lifting it from the trailer and placing it over the wellbore and the pile.

Figure 3:
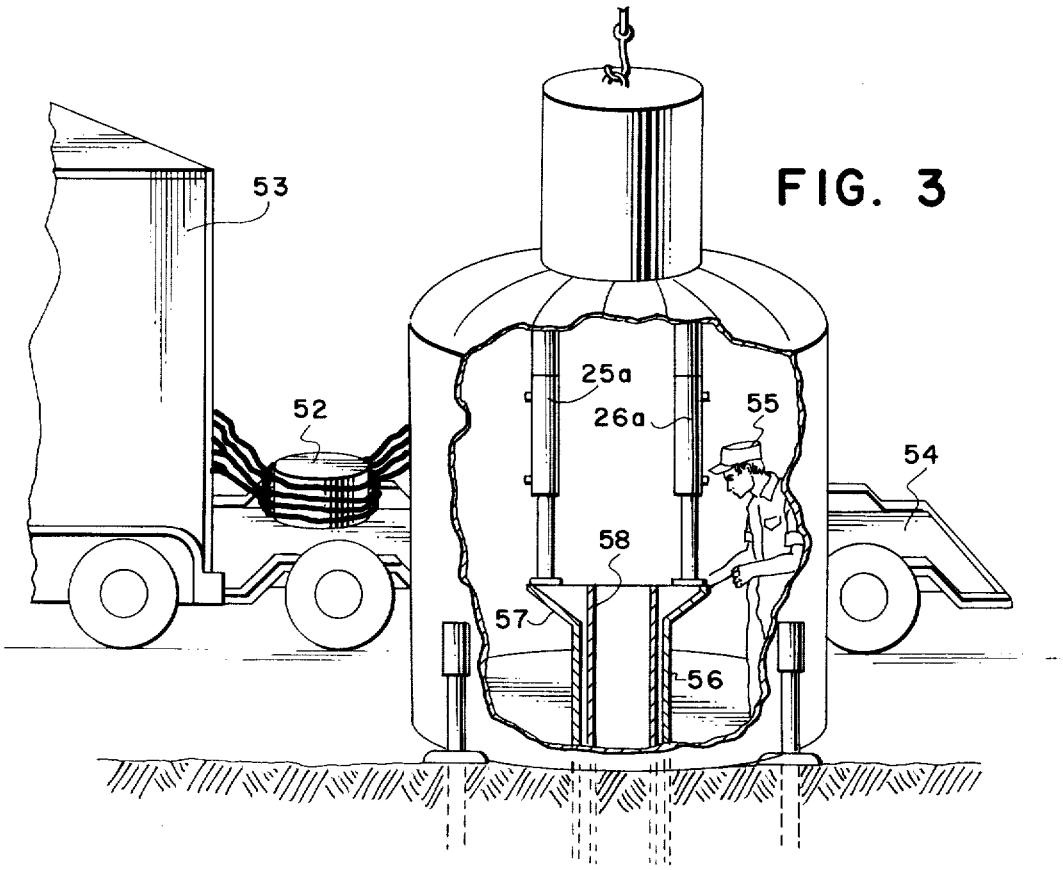
FIG. 3 is a partially cutaway view of the embodiment of FIG. 2 after transfer from trailer to the borehole site.

FIG. 3 illustrates a partial cutaway view of the service module 10a on location at the borehole site. In the cutaway area, a workman 55 is preparing to grout the annulus around the pile. Telescopic grouting tubes 25*a* and 26*a* have been lowered downward to a funnel-type tube 56 having upward and outwardly flared end 57. Pile member 58 is located concentrically in tube 56. Water, electric power, cement and air supplies enter through tubes and hoses 52.

Figure 4:
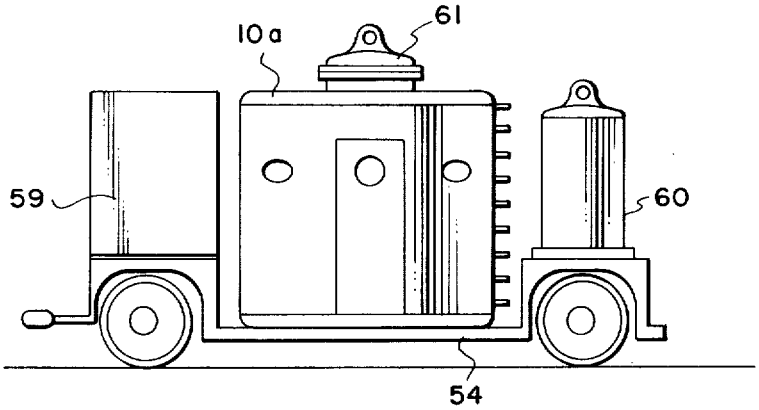
FIG. 4 shows a side elevation of a capsule and accessories on a trailer.

FIG. 4 illustrates a modification of the embodiment of FIGS. 2 and 3. In FIG. 4, slurry capsule 10*a* is transported on trailer 54 with the trailer 54 having at its forward end a hose and equipment storage cabinet 59 and at its rear section a cylindrical capsule extension 60. Capsule 60 is provided to be placed atop slurry capsule 10*a* to provide an extended upper area for situations where piles 58 may extend a great distance above ground. This occurs in areas where the terrain is rough and uneven and, in order for the tops of the piles to be level with each other, the top of one pile may be only a foot or so above the ground whereas the top of another pile may be 6 to 8 feet above the ground.

Figure 5:
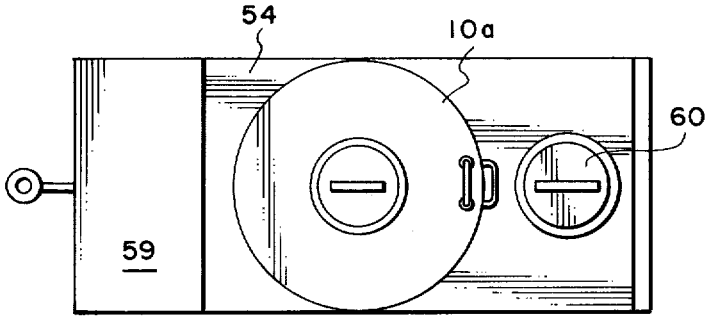
FIG. 5 is a top view of the apparatus of FIG. 4.
Figure 6:
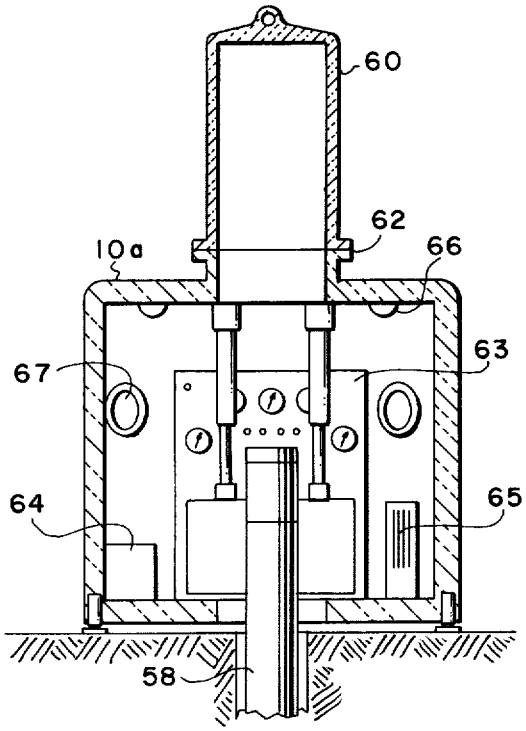
FIG. 6 is a side cross-sectional view of the invention shown in FIGS. 4 and 5.

FIG. 5 illustrates a top view of the placement of the slurry capsule 10*a*, capsule extension 60 and the storage cabinet 59 on trailer 54. FIG. 6 illustrates a cross-sectional side view of the slurry capsule 10*a* in place over the borehole. In FIG. 6, the dome lid 61 on the slurry capsule has been removed and capsule extension 60 has been placed atop capsule 10*a*. Attachment of the capsule extension 60 to the capsule 10*a* is achieved by means of bolted flange 62. The internal structure and furnishings of the capsule 10*a* and their mode of operation are similar to those of the embodiment of FIG. 1. For example, a control panel 63 similar to control panel 21 of FIG. 1 is located within the capsule and has means thereon for controlling such variables as the rate of injection of the grouting slurry or rate of injection of the cement slurry. Capsule 10*a* may also have a hydraulic pump 64, various heaters 65, lights 66 and windows 67 therein.

Figure 7:
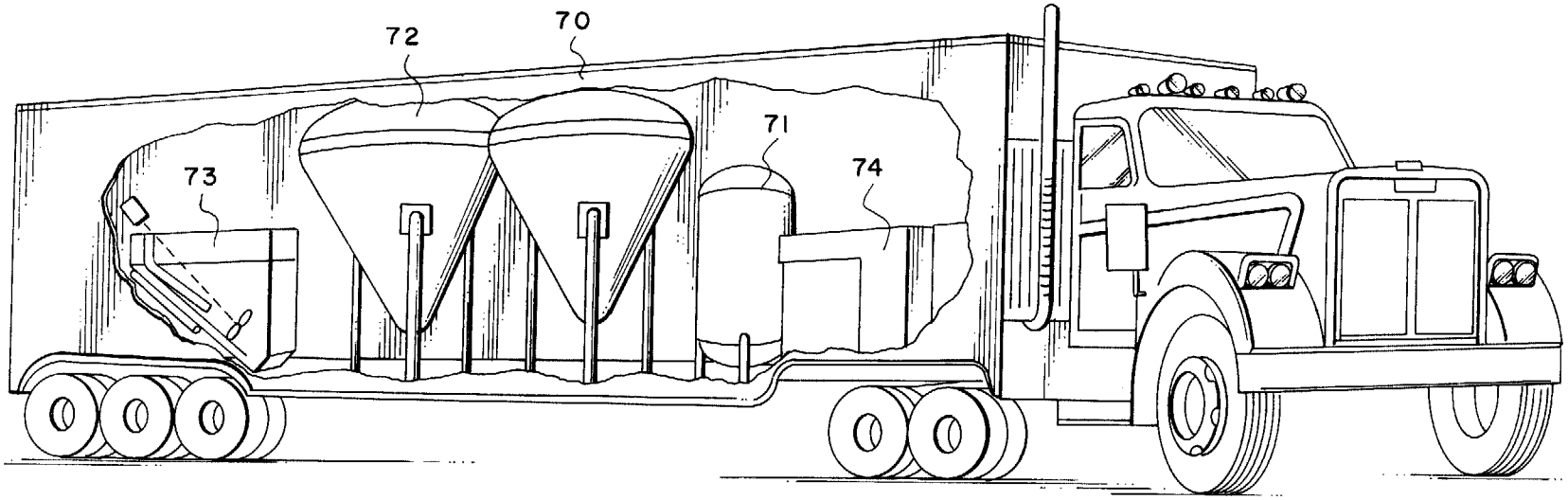
FIG. 7 illustrates a typical truck rig setup for use with this invention.

Referring now to FIG. 7, there is illustrated in partial cutaway view a truck-trailer rig 70 having all of the necessary material and supply systems contained therein. For instance, water tanks 71, bulk tanks 72, and hoppers 73, plus motor-driven pumping system 74 may be located within the trailer. These may be arranged to supply materials through the bottom of the trailer or alternatively, hoses may be connected to the individual tanks to exit through the back of the trailer as shown in FIGS. 2 and 3.

Also, the trailer preferably is insulated and heated against the cold environment and contains sufficient area within for workmen to perform necessary duties with respect to the supply apparatus. It is contemplated that a doorway (not shown) in or near the back of the trailer will be provided for access into the slurry capsule. Thus, it may be seen from the description above with respect to the accompanying FIGS. 1–7 there is provided a self-contained, fully insulated, heated shelter module for placement about a borehole site to allow the performance of full operating procedure by workmen in a controlled sheltered environment. The service module is arranged to contain all of the necessary apparatus and controls for performing all of the required operations on the borehole. The invention provides means of entering and leaving the capsule without exposure to the outside environment.

Although certain preferred embodiments of the present invention have been herein described in order to provide an understanding of the general principles of the invention, it will be appreciated that the various changes and innovations can be effected in the described service module without departing from these principles. For example, wherein the service module is depicted as having rectangular or circular shape it is obvious that any other physical configuration may be used advantageously. Also, whereas certain types of lighting and heating are shown it is obvious that various modifications of this apparatus could be used successfully. All modifications and changes of this type are deemed to be embraced by the spirit and scope of the invention except as the same may be necessarily limited by the appended claims or reasonable equivalents thereof.

The embodiments of the invention in which an exclusive property or privilege is claimed are defined as follows:

1. Apparatus for providing a sheltered work area over a borehole in the ground surface, said apparatus comprising:

structural means providing an enclosed work area and having vertical support members having wall sections jointed together and adapted to retard the flow of heat therethrough;

roof means joined to said wall sections and being adapted to retard the flow of heat therethrough;

floor means joined to the lower portion of said wall sections and adapted to retard the flow of heat therethrough, said floor means having an opening passing therethrough of sufficient size to expose an underground borehole below said apparatus to said enclosed work area;

entrance means in at least one of said wall sections arranged to provide ingress and egress to said work area by workmen;

access means passing through said structural means and adapted to provide one or more openings into said work area through which power and material supply tubes may pass; and, a grouting system having power actuated raising and lowering means, telescopic tubular grouting means, and means for supplying fluids and solid grouting material to said grouting means.

2. The apparatus of claim 1 wherein said structural means has four flat vertical wall sections, said roof means comprises a peaked angular roof atop said four vertical wall sections, and said entrance means comprises a movable door and an extendable external passageway about said door.

3. The apparatus of claim 1 wherein said structural means comprises cylindrical vertical wall sections, said roof means comprises a domed roof section, and said access means comprises a covered hatchway in said domed roof section.

4. The apparatus of claim 3 further comprising an elongated extension structure located between said roof section and said hatchway cover, extending upward from said roof section and having an open inner area therein.

5. An enclosed work structure for providing a life support environment for working personnel performing operations on underground boreholes in hostile climates, said enclosed structure comprising:

insulated vertical wall means enclosing a personnel work area;

insulated floor means covering the bottom of said personnel work area and having an opening therein arranged to communicate said work area with an underground borehole;

insulated roof means atop said vertical wall means and covering said work area;

heating means in said enclosed structure;

lighting means in said enclosed structure;

a plurality of individually adjustable support legs extending downward from said floor means;

access means in said structure arranged to allow ingress and egress into and out of said structure for workmen;

means for supplying a power supply to the interior of said structure;

means for supplying a plurality of fluid and powdered materials into said structure; and, means for controlling said power supply means and said material supply means in said structure.

6. The enclosed structure of claim 5 further comprising means in said structure for mixing and pumping a grouting material, and telescopic tubular means for injecting grouting material into an underground borehole below said structure.

7. The enclosed structure of claim 6 wherein said structure has four flat vertical walls and a peaked angular roof, and said injecting means comprises one or more telescopic tubular pipe assemblies suspended from said roof by a power actuated raising and lowering cylinder.

8. The apparatus of claim 6 wherein said vertical wall means comprises a vertical cylindrical structure and said roof means comprises a domed roof on said cylindrical structure.

9. The apparatus of claim 8 wherein said access means comprises a hatchway in said domed roof generally centrally located therein, and a cover over said hatchway.

10. The apparatus of claim 9 further comprising an elongated extension tube extending upward from said hatchway and having said cover attached over the top thereof.

11. A self-contained fully protected system for grouting pipe piles in extremely cold regions, said system comprising:

an enclosed housing having thermally insulated walls, roof, and flooring and with sufficient enclosed area to allow limited freedom of movement for at least one man therein;

said housing floor having an opening therethrough adapted to receive a piling and allow communication with the annulus between the piling and borehole;

means for introducing power supply and grouting materials into said housing;

means for mixing and pumping said grouting materials in said housing and for controlling said power supply and said mixed grouting materials; and, adjustable means for injecting said mixed grouting materials into an underground borehole.

12. The system of claim 11 further comprising mobile transport trailer means for said housing, said transport trailer means adapted to carry said housing and having equipment storage means thereon.

13. The system of claim 12 including truck means adapted to pull said transport trailer means, said truck means having an enclosed insulated life support area with fluid and material containers and power supply prime mover means therein.

* * * * *